US010265995B2

(12) United States Patent
Jung et al.

(10) Patent No.: US 10,265,995 B2
(45) Date of Patent: Apr. 23, 2019

(54) LASER MARKABLE SECURITY ARTICLES AND DOCUMENTS

(71) Applicant: AGFA-GEVAERT, Mortsel (BE)

(72) Inventors: Jürgen Jung, Mortsel (BE); Rene Geelen, Mortsel (BE); Anouschka Depla, Mortsel (BE); Walther Wouters, Mortsel (BE)

(73) Assignee: AGFA-GEVAERT, Mortsel (BE)

( * ) Notice: Subject to any disclaimer, the term of this patent is extended or adjusted under 35 U.S.C. 154(b) by 0 days.

(21) Appl. No.: 15/537,438

(22) PCT Filed: Dec. 18, 2015

(86) PCT No.: PCT/EP2015/080490
§ 371 (c)(1),
(2) Date: Jun. 19, 2017

(87) PCT Pub. No.: WO2016/102366
PCT Pub. Date: Jun. 30, 2016

(65) Prior Publication Data

US 2018/0264867 A1 Sep. 20, 2018

(30) Foreign Application Priority Data

Dec. 22, 2014 (EP) ..... 14199784

(51) Int. Cl.

| | |
|---|---|
| ***B41M 3/14*** | (2006.01) |
| ***B42D 25/324*** | (2014.01) |
| ***B42D 25/41*** | (2014.01) |
| ***B42D 25/36*** | (2014.01) |
| ***B41M 5/26*** | (2006.01) |
| ***B41M 5/30*** | (2006.01) |

(52) U.S. Cl.
CPC ..... *B42D 25/324* (2014.10); *B41M 3/14* (2013.01); *B41M 3/142* (2013.01); *B41M 5/26* (2013.01); *B41M 5/30* (2013.01); *B42D 25/36* (2014.10); *B42D 25/41* (2014.10)

(58) Field of Classification Search
CPC ..... B41M 3/14; B41M 3/142; B41M 5/323; B41M 5/46; B41M 5/465; B41J 2/44; B41J 2/442; B42D 25/324; B42D 25/36
USPC ..... 503/201; 283/88, 91
See application file for complete search history.

(56) References Cited

U.S. PATENT DOCUMENTS 4,720,449 A 1/1988 Borror et al.
4,765,656 A 8/1988 Becker et al.
(Continued)

FOREIGN PATENT DOCUMENTS

EP 0 219 012 A2 4/1987
EP 2 181 858 A1 5/2010
(Continued)

OTHER PUBLICATIONS

Official Communication issued in International Patent Application No. PCT/EP2015/080490, dated Mar. 10, 2016.

*Primary Examiner* — Bruce H Hess
(74) *Attorney, Agent, or Firm* — Keating and Bennett, LLP

(57) ABSTRACT

A security article includes a laser markable layer and a transparent outer layer or sheet having lenticular lenses on its outer surface, both provided, in this order, on an opaque core support, characterized in that the laser markable layer has a dry layer thickness of less than 50 μm. An improved contrast is obtained between interlaced images exposed into the security article of the invention.

11 Claims, 8 Drawing Sheets

(1)

(56) References Cited

U.S. PATENT DOCUMENTS

| | | | |
|---|---|---|---|
| 2007/0063053 | A1 | 3/2007 | Bergmann et al. |
| 2012/0194916 | A1 | 8/2012 | Cape et al. |

FOREIGN PATENT DOCUMENTS

| | | | |
|---|---|---|---|
| EP | 2 567 825 | A1 | 3/2013 |
| EP | 2 719 540 | A1 | 4/2014 |
| WO | 2005/058610 | A2 | 6/2005 |
| WO | 2009/056354 | A1 | 5/2009 |

Figure 5: Security Card SC-01; 2 spacer sheets; exposure CL#2

Figure 6: Security Card SC-03; 2 spacer sheets; exposure CL#2

Figure 7: Security Card SC-02; 3 spacer sheets; exposure CL#2

Figure 8: Security Card SC-04; 3 spacer sheets; exposure CL#2

Figure 9: 4-card composite and 4 AOI´s
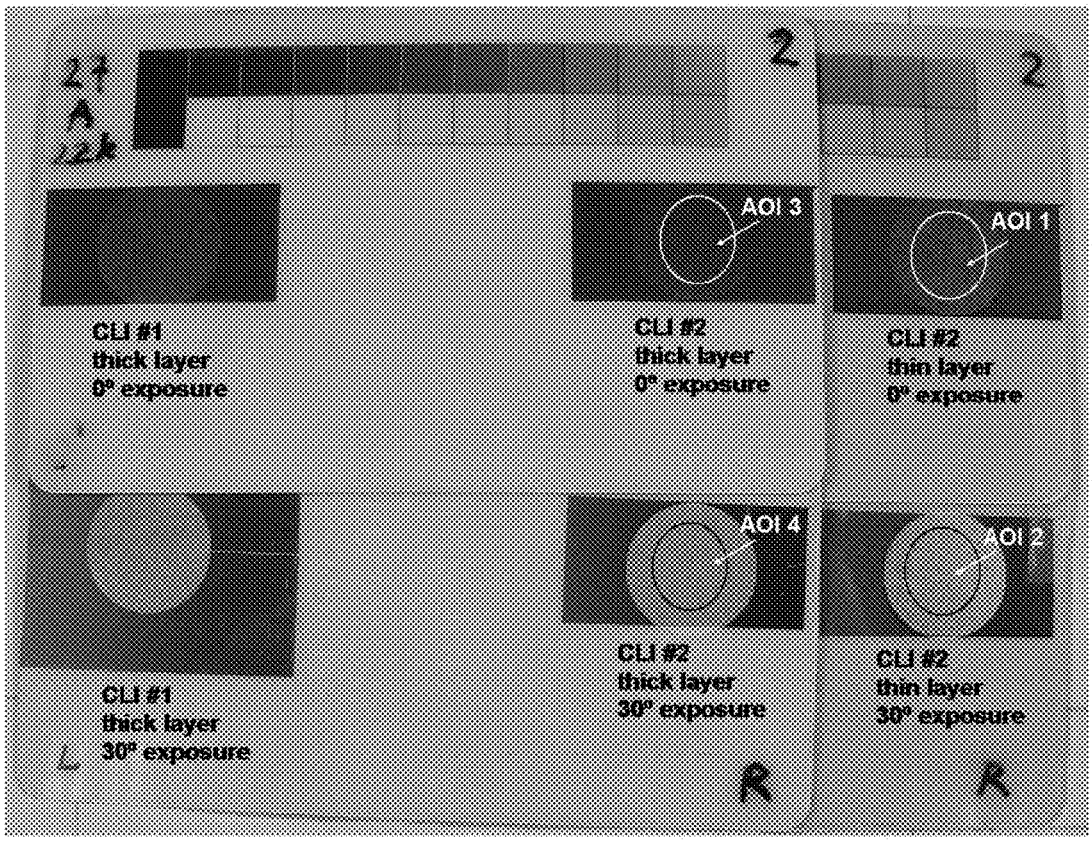

LASER MARKABLE SECURITY ARTICLES AND DOCUMENTS

CROSS REFERENCE TO RELATED APPLICATIONS

This application is a 371 National Stage Application of PCT/EP2015/080490, filed Dec. 18, 2015. This application claims the benefit of priority to European Application No. 14199784.1, filed Dec. 22, 2014, which is incorporated by reference herein in its entirety.

BACKGROUND OF THE INVENTION

1. Field of the Invention

This invention relates to security articles, in particular to security documents comprising Changeable Laser Image (CLI) functionality.

2. Description of the Related Art

Security cards are widely used for various security related applications such as identification purposes (ID cards) and financial transfers (credit cards). Such cards typically consist of a laminated structure consisting of various paper or plastic sheets and layers wherein some of them may carry alphanumeric data and a picture of the card holder. So called 'smart cards' can also store digital information by including an electronic chip in the card body. A principal objective of such security cards is that they contain security elements that cannot be easily modified or reproduced, such that any attempt of forgery of the card is easily detected.

Two techniques frequently used for preparing security documents are laser marking and laser engraving. In literature, laser engraving is often incorrectly used as synonymous term for laser marking. In laser marking, a colour change is observed by local heating of material, while in laser engraving material is removed by laser ablation.

Well known in the field of laser markable security documents is the use of laser markable polymeric supports. Laser marking produces a colour change from white to black in a laser markable support through carbonization of the polymer, usually polycarbonate as disclosed in e.g. EP-A 2181858.

During the past last years, there is an increasing interest of using laser markable layers. The advantage of using a laser markable layer coated on a support instead of a laser markable support, is that a polymeric support can be used which has better physical properties than the laser markable supports, such as for example a higher flexibility or durability than a polycarbonate support as disclosed in e.g. EP-A 2567825 (AGFA GEVAERT).

There is also an increasing interest in using laser marking to produce coloured images in a security document. Therefore, laser markable layers are used which are composed of colour forming compounds (also called "leuco-dyes") which can change from essentially colourless or pale-coloured to coloured when exposed to for example heat, such as disclosed in for example EP-A 2648920.

The colour laser markable layers may comprise an infrared absorbing dye (IR dye) or an infrared absorbing pigment (IR pigment), both absorbing the IR radiation and converting it into heat.

An advantage of using IR dyes is that the absorption spectrum of an IR dye tends to be narrower than that of an IR pigment. This allows the production of multicoloured articles and security documents from precursors having a plurality of laser markable layers containing different IR dyes and colour foming compounds. The IR dyes having a different maximum absorption wavelength can then be adressed by IR lasers with corresponding emmision wavelengths causing colour formation only in the laser markable layer of the adressed IR dye. Such multicolour articles have been disclosed in for example U.S. Pat. No. 4,720,449 and EP-A 2719540.

Changeable Laser Image (CLI) or Multiple Laser Image (MLI) is a security feature based on lenticular lens system. The lenticular lens system consists of multiple parallel lenticular lenses and two or more interlaced images underneath. The interlaced images can be viewed independently through the lenses according to different observation angles. The principle of such lenicatular images was firstly demonstrated by Gabriel Lippman in 1908. Then it has been developed to provide various visual effects, such as 3-dimensional (3D), animation, flip, morph, zoom or combinations thereof. CLI is a flip visual effect, which means two or more images flip back and forth by changing viewing angles. As it is impossible to reproduce without specialized printing equipment, it is widely used for making secure identification documents provided with mulitple images.

SUMMARY OF THE INVENTION

Preferred embodiments of the present invention provide a security article with improved Changeable Laser Image (CLI) functionality.

This and other advantages and benefits are realised by the security article described below.

Further advantages and embodiments of the present invention will become apparent from the following description and the dependent claims.

BRIEF DESCRIPTION OF THE DRAWINGS

FIG. 9 gives a photograph of the 4-card construction used in the examples to evaluate the contrast between the images exposed at 0° and 30°.

DETAILED DESCRIPTION OF THE PREFERRED EMBODIMENTS

Definitions

Figure 1:
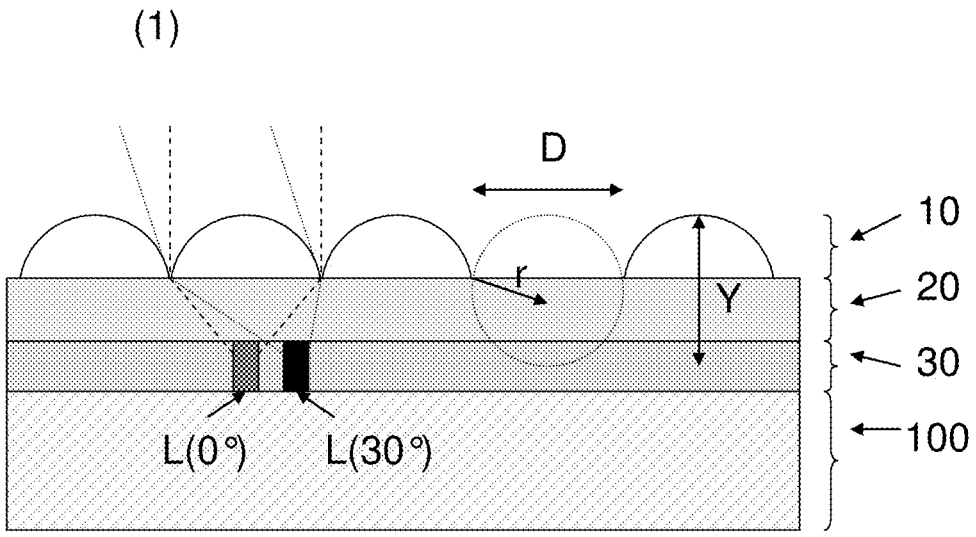
FIG. 1 shows a cross section of an embodiment of a security article according to the present invention.

The term layer as used herein encompasses both self-supporting layers, also referred to as (polymeric) support, sheet or foil, and a layer which is considered not to be self-supporting and is manufactured by coating it on a (polymeric) support or foil.

The term incident angle as used herein is the angle between a ray incident on a surface and the line perpendicular to the surface at the point of incidence, also called the normal.

The term leuco dye as used herein refers to compounds which can change from essentially colourless or pale-coloured to coloured when irradiated with UV light, IR light and/or heated.

PET is an abbreviation for polyethylene terephthalate.

PETG is an abbreviation for polyethylene terephthalate glycol, the glycol indicating glycol modifiers which are incorporated to minimize brittleness and premature aging that occur if unmodified amorphous polyethylene terephthalate (APET) would be used in the production of cards.

PET-C is an abbreviation for crystalline PET, i.e. a biaxially stretched polyethylene terephthalate. Such a polyethylene terephthalate support has excellent properties of dimensional stability.

The definitions of security features correspond with the normal definition as adhered to in the Glossary of Security Documents—Security features and other related technical terms as published by the Consilium of the Council of the European Union on Aug. 25, 2008 (Version: v.10329.02.b.en) on its website: http://www.consilium.europa.eu/prado/EN/glossaryPopup.html.

The term security document precursor as used herein refers to the fact that one or more security features still have to be applied to the precursor, for example laser marking, in order to obtain the final security document.

The term alkyl means all variants possible for each number of carbon atoms in the alkyl group i.e. methyl, ethyl, for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethyl-propyl and 2-methyl-butyl etc.

The term alkoxy means all variants possible for each number of carbon atoms in the alkyl group i.e. methoxy, ethoxy, for three carbon atoms: n-propoxy and isopropoxy; for four carbon atoms: n-butoxy, isobutoxy and tertiary-butoxy etc.

The term aryloxy means Ar—O— wherein Ar is an optionally substituted aryl group.

Unless otherwise specified a substituted or unsubstituted alkyl group is preferably a $C_1$ to $C_6$-alkyl group.

Unless otherwise specified a substituted or unsubstituted alkenyl group is preferably a $C_2$ to $C_6$-alkenyl group.

Unless otherwise specified a substituted or unsubstituted alkynyl group is preferably a $C_2$ to $C_6$-alkynyl group.

Unless otherwise specified a substituted or unsubstituted aralkyl group is preferably a phenyl group or a naphthyl group including one, two, three or more $C_1$ to $C_6$-alkyl groups.

Unless otherwise specified a substituted or unsubstituted alkaryl group is preferably a $C_1$ to $C_6$-alkyl group including an aryl group, preferably a phenyl group or naphthyl group.

Unless otherwise specified a substituted or unsubstituted aryl group is preferably a substituted or unsubstituted phenyl group or naphthyl group.

A cyclic group includes at least one ring structure and may be a monocyclic- or polycyclic group, meaning one or more rings fused together.

A heterocyclic group is a cyclic group that has atoms of at least two different elements as members of its ring(s). The counterparts of heterocyclic groups are homocyclic groups, the ring structures of which are made of carbon only. Unless otherwise specified a substituted or unsubstituted heterocyclic group is preferably a five- or six-membered ring substituted by one, two, three or four heteroatoms, preferably selected from oxygen atoms, nitrogen atoms, sulphur atoms, selenium atoms or combinations thereof.

An alicyclic group is a non-aromatic homocyclic group wherein the ring atoms consist of carbon atoms.

The term heteroaryl group means a monocyclic- or polycyclic aromatic ring comprising carbon atoms and one or more heteroatoms in the ring structure, preferably, 1 to 4 heteroatoms, independently selected from nitrogen, oxygen, selenium and sulphur. Preferred examples of heteroaryl groups include, but are not limited to, pyridinyl, pyridazinyl, pyrimidyl, pyrazyl, triazinyl, pyrrolyl, pyrazolyl, imidazolyl, (1,2,3,)- and (1,2,4)-triazolyl, pyrazinyl, pyrimidinyl, tetrazolyl, furyl, thienyl, isoxazolyl, thiazolyl, isoxazolyl, and oxazolyl. A heteroaryl group can be unsubstituted or substituted with one, two or more suitable substituents. Preferably, a heteroaryl group is a monocyclic ring, wherein the ring comprises 1 to 5 carbon atoms and 1 to 4 heteroatoms.

The term substituted, in e.g. substituted alkyl group means that the alkyl group may be substituted by other atoms than the atoms normally present in such a group, i.e. carbon and hydrogen. For example, a substituted alkyl group may include a halogen atom or a thiol group. An unsubstituted alkyl group contains only carbon and hydrogen atoms.

Unless otherwise specified a substituted alkyl group, a substituted alkenyl group, a substituted alkynyl group, a substituted aralkyl group, a substituted alkaryl group, a substituted aryl, a substituted heteroaryl and a substituted heterocyclic group are preferably substituted by one or more substituents selected from the group consisting of methyl, ethyl, n-propyl, isopropyl, n-butyl, 1-isobutyl, 2-isobutyl and tertiary-butyl, ester, amide, ether, thioether, ketone, aldehyde, sulfoxide, sulfone, sulfonate ester, sulphonamide, —Cl, —Br, —I, —OH, —SH, —CN and $—NO_2$.

Laser Markable Article

The laser markable article (1) according to the present invention comprises a laser markable layer (30) and a transparent outer layer having lenticular lenses on its outer surface (10), both provided, in this order, on an opaque core support (100), characterized in that the laser markable layer has a dry layer thickness of less than 50 μm.

In a preferred embodiment, the laser markable article is a security document, preferably selected from the group consisting of a passport, a personal identification card and a product identification document.

The security document preferably also contains electronic circuitry, more preferably the electronic circuitry includes a RFID chip with an antenna and/or a contact chip. The security document is preferably a "smart card", meaning an identification card incorporating an integrated circuit. In a preferred embodiment the smart card includes a radio frequency identification or RFID-chip with an antenna. Inclusion of electronic circuitry makes forgery more difficult.

The security document preferably has a format as specified by ISO 7810. ISO 7810 specifies three formats for identity cards: ID-1 with the dimensions 85.60 mm×53.98 mm, a thickness of 0.76 mm is specified in ISO 7813, as used for bank cards, credit cards, driving licences and smart cards; ID-2 with the dimensions 105 mm×74 mm, as used in German identity cards, with typically a thickness of 0.76 mm; and ID-3 with the dimensions 125 mm×88 mm, as used for passports and visa's. When the security cards include one or more contactless integrated circuits then a larger thickness is tolerated, e.g. 3 mm according to ISO 14443-1.

Top Lens Layer

The top lens layer (TLL, 10) is an outer layer of the laser markable article having lenticular lenses on its outer surface.

The top lens layer is preferably a sheet or foil having lenticular lenses on its outer surface.

A lenticular lens is an array of microlenses, designed in such a way that when viewed from different angles, different images located beneath the lenticular lenses become, independently from each other, visible.

In principle any type of microlens may be used in the present invention, as long as the optical design of the microlens array allows addressing and subsequent visual observation of distinct images in the laser markable layer making use of different incident angles.

Microlenses suitable for the present invention include those that refract light at a suitable curved surface of a homogenous material such as plano-convex lenses, double convex lenses, and Fresnel lenses. Lenses of any symmetry, such as spherical or cylindrical microlenses may be used in the top lens layer or sheet, cylindrical microlenses being particularly preferred.

Also, both spherical and aspherical surfaces are applicable to lenses that may be used in the present invention. It is not essential for the microlenses to have a curved surface. Gradient refractive index (GRIN) lenses image light by gradual refraction throughout the bulk of the material as a result of small variation in refractive index. Microlenses, based on diffraction, such a Fresnel zone plates can also be used. GRIN lenses and amplitude or mask Fresnel zone plates enable the surface containing the microlens array to be planar and may offer advantages in for example print receptivity and durability.

Although the microlens array could comprise discrete lenslets such as microspheres, rods, beads or cylinders, it is preferably to use a periodic array of lenses generated by a replication process. Master microlenses arrays can be produced by number of techniques such as photothermal techniques, melt and reflow of photoresist and photoresist sculpture. Such techniques are known to those skilled in the art and are detailed in chapter 5 of "*Micro-optics: Elements, Systems, and Applications*" edited by Hans Peter Herzig, published by Taylor and Francis, reprinted 1998. The master microlens structure can then be physically copied by commercially available replication techniques such a hot embossing, moulding or casting.

Materials into which the microlens structures can be replicated include but are not limited to thermoplastic polymers such as polycarbonate and polymethyl-methacrylate for the hot embossing and moulding processes and acrylated epoxy materials curable by heat or radiation for the casting process.

Another replication process to prepare a microlens array is replication via casting into a UV curable coating applied to a carrier polymer film such as PET.

Spacer Layer

The laser markable article may comprise a transparent spacer layer (20) located between the top lens layer or sheet (10) and the laser markable layer (30).

The spacer layer preferably consists of one or more spacer sheets or foils.

In principle, any transparent material may be used to form the spacer layer.

The spacer layer preferably has a refractive index which is close to the refractive index of the other layers making up the security article, especially of the top lens layer or sheet. The difference between the refractive index of the spacer layer and the refractive index of the top lens layer is preferably less than 0.1, more preferably less than 0.05.

The spacer layer is applied to adjust the distance Y between the microlenses and the middle of laser markable layer. The thickness of the spacer layer depends on the choice of the lenses in the top lens layer. Depending on the chosen parameters R and PD, there is a depth Y, at which the laser markable layer has to be placed, in order to achieve optimal contrast between the two images, encoded in the laser markable layer, and intended to be viewed independently from each other at 2 different viewing angles.

Laser Markable Layer

The laser markable article according to the present invention includes a laser markable layer. The dry layer thickness of the laser markable layer is less than 50 μm, preferably less than 25 μm, more preferably less than 15 μm, most preferably less than 10 μm.

Any laser markable layer known in the art may be used in the present invention as long as its dry thickness is as described above.

More then one laser markable layers, for example two, three or four, may be used in the security article according to the present invention. When more than one laser markable layers are used, it is preferred that the total thickness of the laser markable layers is less than 50 μm.

When more than one laser markable layers are used, multi-coloured images may be formed, or the images which are meant to be viewed independently from each other, depending on the viewing angle, may be of a different single colour.

When more than one laser markable layers are used, each laser markable layer preferably comprise an infrared absorbing dye having a different maximum absorption maximum in the infrared region, so that they can be selectively addressed by an appropriate IR laser. For example, when three laser markable layers are used, the laser markable layers and the infrared dyes disclosed in EP-A 2719540 are preferably used.

When more than one laser markable layers are used, intermediate layers located in between the laser markable layers may be present, for example to avoid colour contamination or to improve the selectivity of the different laser markable layers. For example, using the set of laminates disclosed in EP-A 2719541 may result in three laser markable layer separated from each other by an intermediate layer.

According to a first preferred embodiment, the laser markable layer is capable of forming a black colour upon exposure to infrared radiation by carbonization.

According to a second preferred embodiment, the laser markable layer is capable of forming a colour by the reaction of a leuco dye upon exposure to infrared absorption.

When more than one laser markable layer is used, a laser markable layer according to the first embodiment may be combined with a laser markable layer according to the second embodiment.

The laser markable layer may be present as a self supporting layer, but is preferably provided onto a support by co-extrusion or any conventional coating technique, such as dip coating, knife coating, extrusion coating, spin coating, spray coating, slide hopper coating and curtain coating. Preferably the laser markable layer is coated with a slide hopper coater or a curtain coater. The laser markable layer is preferably coated onto a transparent polymeric support including a subbing layer.

Laser Markabe Layer (Carbonization)

According to one embodiment, the laser markable layer is capable of forming a black colour upon exposure to infrared radiation by carbonization.

Such a laser markable layer is disclosed in EP-A 2335967. The thickness of the laser markable layer disclosed therein may be less than 25 μm while still capable of delivering sufficient optical density.

The polymers suitable for laser marking, i.e. carbonization, usually include polycarbonate (PC), polybutylene terephthalate (PBT), polyvinyl chloride (PVC), polystyrene (PS) and copolymers thereof, such as e.g. aromatic polyester-carbonate and acrylonitrile butadiene styrene (ABS). However, in order to obtain a sufficient optical density by laser marking in the relatively thin laser markable layers of the security film according to the present invention, it was found that only a few polymers were suitable and that the presence of a laser additive was preferred.

Preferred polymers suitable for laser markable layer according to the present invention are selected from the group consisting of polystyrene, polycarbonate and styrene acrylonitrile. A mixture of two or more of these polymers may also be used.

Particularly preferred, the laser markable layer contains polystyrene. Polystyrene was observed to deliver the highest optical densities by laser marking and also exhibited the highest laser sensitivity.

Laser markable layers based on styrene acrylonitrile polymers are less safe since toxic acrylonitrile is released during laser marking.

The colour change in the polymeric materials is accelerated by the addition of a "laser additive", a substance which absorbs the laser light and converts it to heat.

Suitable laser additives include antimony metal, antimony oxide, carbon black, mica (sheet silicate) coated with metal oxides and tin-antimony mixed oxides. In WO 2006/042714, the dark coloration of plastics is obtained by the use of additives based on various phosphorus-containing mixed oxides of iron, copper, tin and/or antimony.

Suitable commercially available laser additives include mica coated with antimony-doped tin oxide sold under the trade name of Lazerflair™ 820 and 825 by MERCK; copper hydroxide phosphate sold under the trade name of Fabulase™ 322 by BUDENHEIM; aluminium heptamolybdate sold under the trade name of AOM™ by HC STARCK; and antimony-doped tin oxide pigments such as Engelhard Mark-it™ sold by BASF.

In a preferred embodiment, the laser markable layer contains carbon black particles. This avoids the use of heavy metals in manufacturing these security documents. Heavy metals are less desirable from an ecology point of view and may also cause problems for persons having a contact allergy based on heavy metals.

Suitable carbon blacks include Special Black 25, Special Black 55, Special Black 250 and Farbruss™ FW2V all available from EVONIK; Monarch™ 1000 and Monarch™ 1300 available from SEPULCHRE; and Conductex™ 975 Ultra Powder available from COLUMBIAN CHEMICALS CO.

The use of carbon black pigments as laser additives may lead to an undesired background colouring of the security document precursor. For example, a too high concentration of carbon black in a laser markable layer in security document having a white background leads to grey security documents. A too low concentration of carbon black slows down the laser marking or requires a higher laser power leading to undesirable blister formation. Both problems were solved in the present invention by using carbon black particles having a small average particle size and present in a low concentration.

The numeric average particle size of the carbon black particles is preferably between 5 nm and 250 nm, more preferably between 10 nm and 100 nm and most preferably between 30 nm and 60 nm. The average particle size of carbon black particles can be determined with a Brookhaven Instruments Particle Sizer BI90plus based upon the principle of dynamic light scattering. The measurement settings of the BI90plus are: 5 runs at 23° C., angle of 90°, wavelength of 635 nm and graphics=correction function.

For avoiding grey background colouring of the security article, for example a security document, carbon black is preferably present in a concentration of less than 0.08 wt %, more preferably present in a concentration of less than 0.08 wt %, and most preferably present in the range 0.01 to 0.03 wt %, all based on the total weight of the laser markable polymer(s).

Colour Laser Markabe Layer

According to another embodiment, the laser markable layer is capable of forming a colour by the reaction of a leuco dye upon exposure to infrared absorption.

The laser markable layer according to this embodiment comprises at least one leuco dye and an infrared absorbing compound. The laser markable layer may further comprise a binder, an acid scavenger, and other ingredients to further optimize its properties.

The infrared absorbing compound may be an infrared absorbing dye or an infrared absorbing pigment. Also, a combination of an infrared absorbing dye and pigment may be used.

A mixture of different leuco dyes may be used in a single colour laser markable layer to optimize the colour obtained. The colour referred to herein also include black.

Infrared Absorbing Dyes

Suitable examples of infrared dyes (IR dyes) include, but are not limited to, polymethyl indoliums, metal complex IR dyes, indocyanine green, polymethine dyes, croconium dyes, cyanine dyes, merocyanine dyes, squarylium dyes, chalcogenopyryloarylidene dyes, metal thiolate complex dyes, bis(chalcogenopyrylo)polymethine dyes, oxyindolizine dyes, bis(aminoaryl)polymethine dyes, indolizine dyes, pyrylium dyes, quinoid dyes, quinone dyes, phthalocyanine dyes, naphthalocyanine dyes, azo dyes, (metalized) azomethine dyes and combinations thereof.

A particularly preferred infrared dye is 5-[2,5-bis[2-[1-(1-methylbutyl)-benz[cd]indol-2(1H)-ylidene]ethylidene] cyclopentylidene]-1-butyl-3-(2-methoxy-1-methylethyl)-2,4,6(1H,3H,5H)-pyrimidinetrione (CASRN 223717-84-8) represented by the Formula IR-1:

IR-1

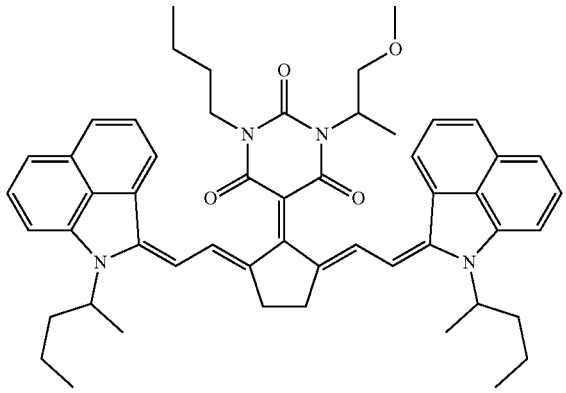

The infrared dye IR-1 has an absorption maximum $\lambda_{max}$ of 1052 nm making it very suitable for a Nd-YAG laser having an emission wavelength of 1064 nm.

Other preferred infrared dyes are those disclosed in EP-A 2722367 and the unpublished EP-A 14166498.7 (filed on 30, Apr. 2014).

The amount of IR dyes is preferably between 0.005 and 1.000 g/m$^2$, more preferably between 0.010 and 0.500 g/m$^2$, most preferably between 0.015 and 0.050 g/m$^2$. Enough IR dye has to be present to ensure sufficient colour density formation upon exposure to IR radiation. However, using too much IR dye may result in unwanted background coloration of the laser markable materials.

Infrared Absorbing Pigments

Suitable examples of infrared absorbing pigments include but are not limited to carbon black such as acetylene black, channel black, furnace black, lamp black, and thermal black; oxides, hydroxides, sulfides, sulfates and phosphates of metals such as copper, bismuth, iron, nickel, tin, zinc, manganese, zirconium, tungsten, lanthanum, and antimony including lanthane hexaboride, indium tin oxide (ITO) and antimony tin oxide, titanium black and black iron oxide.

The infrared dye classes disclosed above may also be used as infrared absorbing pigments, for example cyanine pigment, merocyanine pigment, etc.

A preferred infrared absorbing pigment is carbon black.

The particle size of the pigment is preferably from 0.01 to 10 μm, more preferably from 0.05 to 1 μm.

The amount of the infrared absorbing pigment is between 10 and 1000 ppm, preferably between 25 and 750 ppm, more preferably between 50 and 500 ppm, most preferably between 100 and 250 ppm, all relative to the total dry weight of the laser markable layer. An amount of infrared absorbing pigment above 1000 ppm results in a too high background density of the laser markable article.

Leuco Dyes

All publicly-known leuco dyes can be used and are not restricted. They are for example widely used in conventional pressure-sensitive, photosensitive or thermally-sensitive recording materials. For more information about leuco dyes, see for example Chemistry and Applications of Leuco Dyes, Ramaiah Muthyala, Plenum Press, 1997.

A number of classes of leuco dyes may be used as colour forming compounds in the present invention, such as for example: spiropyran leuco dyes such as spirobenzopyrans (e.g. spiroindolinobenzopyrans, spirobenzo-pyranobenzopyrans, 2,2-dialkylchromenes), spironaphtooxazine and spirothiopyran; leuco quinone dyes; azines such as oxazines, diazines, thiazines and phenazine; phthalide- and phthalimidine-type leuco dyes such as triarylmethane phtalides (e.g. crystal violet lactone), diarylmethane phthalides, monoarylmethane phthalides, heterocyclic substituted phthalides, alkenyl substituted phthalides, bridged phthalides (e.g. spirofluorene phthalides and spirobenzanthracene phthalides) and bisphthalides; fluoran leuco dyes such as fluoresceins, rhodamines and rhodols; triarylmethanes such as leuco crystal violet; ketazines; barbituric acid leuco dyes and thiobarbituric acid leuco dyes.

The laser markable layer(s) may comprise more then one leuco dye, typically to obtain a specific desired colour.

The leuco dye is preferably present in the laser markable layer in an amount of 0.05 to 5.00 g/m$^2$, more preferably in an amount of 0.10 to 3.00 g/m$^2$, most preferably in an amount of 0.20 to 1.00 g/m$^2$.

The following reaction mechanisms and leuco dyes are suitable to form a coloured dye.

1. Protonation of a Leuco Dye after Fragmentation of an Acid Generator

The reaction mechanism can be represented by:

Leuco-dye+acid generator→Leuco-dye+acid→Coloured Dye

All publicly-known photo- and thermal acid generators can be used for the present invention. They can optionally be combined with a photosensitizing dye. Photo- and thermal acid generators are for example widely used in conventional photoresist material. For more information see for example "Encyclopaedia of polymer science", 4th edition, Wiley or "Industrial Photoinitiators, A Technical Guide", CRC Press 2010.

Preferred classes of photo- and thermal acid generators are iodonium salts, sulfonium salts, ferrocenium salts, sulfonyl oximes, halomethyl triazines, halomethylarylsulfone, α-haloacetophenones, sulfonate esters, t-butyl esters, allyl substituted phenols, t-butyl carbonates, sulfate esters, phosphate esters and phosphonate esters.

Preferred Leuco Dyes are phthalide- and phthalimidine-type leco dyes such as triarylmethane phtalides, diarylmethane phthalides, monoarylmethane phthalides, heterocyclic substituted phthalides, alkenyl substituted phthalides, bridged phthalides (e.g. spirofluorene phthalides and spirobenzanthracene phthalides) and bisphthalides; and fluoran Leuco Dyes such as fluoresceins, rhodamines and rhodols.

In a more preferred embodiment of the present invention, a combination is used of at least one compound selected from the group consisting of CASRN 50292-95-0, CASRN 89331-94-2, CASRN1552-42-7 (crystal violet lactone), CASRN148716-90-9, CASRN 630-88-6, CASRN 36889-76-7 or CASRN 132467-74-4 as the Leuco Dye and at least one compound selected from the group consisting of CASRN 58109-40-3, CASRN 300374-81-6, CASRN 1224635-68-0, CASRN 949-42-8, CASRN 69432-40-2, CASRN 3584-23-4, CASRN 74227-35-3, CASRN 953-91-3 or CASRN6542-67-2 as acid generator.

2. Oxidation of a Triarylmethane Leuco Dye

The reaction mechanism can be represented by:

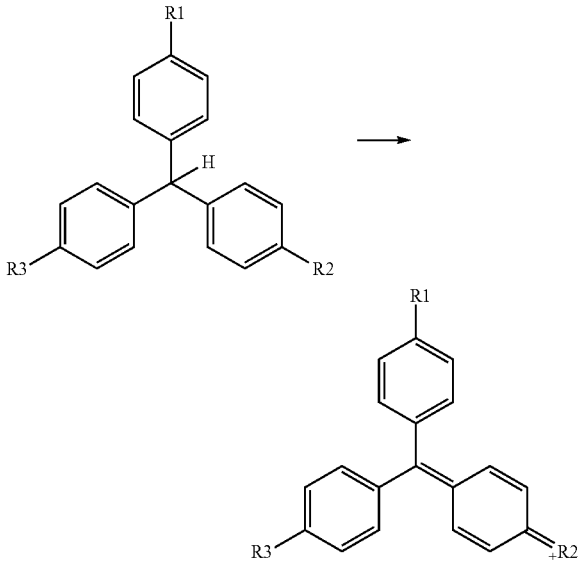

wherein R1, R2 and R3 each independently represent an amino group, an optionally substituted mono- or dialkylamino group, a hydroxyl group or an alkoxy group. R1 and R3 also each independently represent a hydrogen atom or an optionally substituted alkylene, arylene, or heteroarylene. A preferred leuco dye for the present invention is leuco crystal violet (CASRN 603-48-5).

3. Oxidation of a Leuco Quinone Dye

The reaction mechanism can be represented by

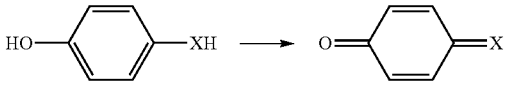

wherein X represents an oxygen atom or an optionally substituted amino or methine group.

4. Fragmentation of a Leuco Dye

The reaction mechanism can be represented by:

Leuco Dye-FG→Dye wherein FG represents a fragmenting group.

Preferred leuco dyes are oxazines, diazines, thiazines and phenazine. A particularly preferred leuco dye (CASRN104434-37-9) is shown in EP 174054 (POLAROID) which discloses a thermal imaging method for forming colour images by the irreversible unimolecular fragmentation of one or more thermally unstable carbamate moieties of an organic compound to give a visually discernible colour shift from colourless to coloured.

The fragmentation of a leuco dye may be catalyzed or amplified by acids, photo acid generators, and thermal acid generators.

5. Ring Opening of Spiropyran Leuco Dyes

The reaction mechanism can be represented by:

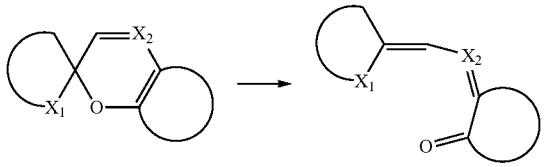

wherein $X_1$ represents an oxygen atom, an amino group, a sulphur atom or a selenium atom and $X_2$ represents an optionally substituted methine group or a nitrogen atom.

The preferred spiropyran leuco dyes for the present invention are spiro-benzopyrans such as spiroindolinobenzopyrans, spirobenzopyranobenzopyrans, 2,2-dialkylchromenes; spironaphtooxazines and spirothiopyrans. In a particularly preferred embodiment, the spiropyran leuco dyes are CASRN 160451-52-5 or CASRN 393803-36-6. The ring opening of a spiropyran leuco dye may be catalyzed or amplified by acids, photo acid generators, and thermal acid generators.

In a preferred embodiment of a laser markable layer for producing a cyan color, the cyan color forming compound has a structure according to Formulae CCFC1, CCFC2 or CCFC3.

CCFC1

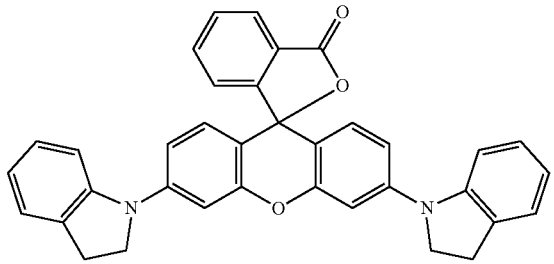

CCFC2

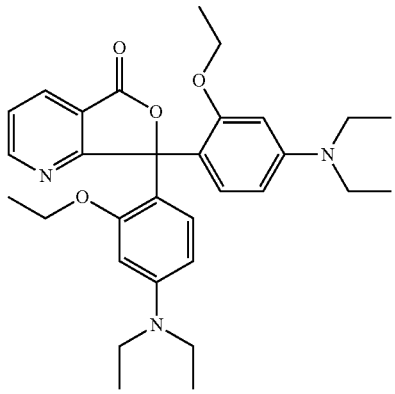

-continued

CCFC3

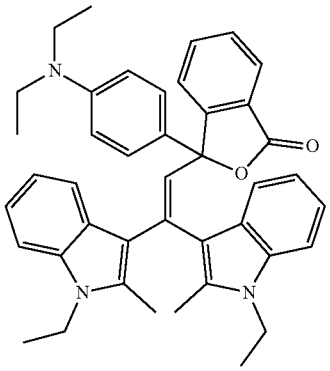

In a preferred embodiment of a laser markable layer for producing a magenta color, the magenta color forming compound has a structure according to Formula MCFC2:

MCFC2

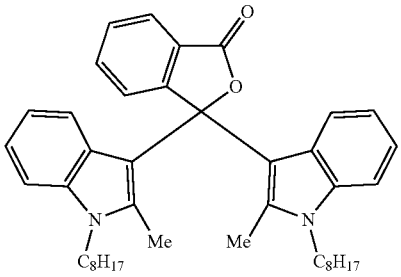

In a preferred embodiment of a laser markable layer for producing a red color, the red color forming compound has a structure according to Formula RCFC:

RCFC

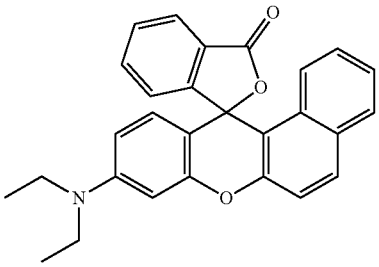

In a preferred embodiment of a laser markable layer for producing a yellow color, the yellow color forming compound has a structure according to Formula YCFC:

YCFC

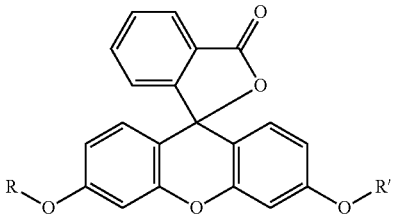

wherein R, R' are independently selected from a group consisting of a linear alkyl group, a branched alkyl group, an aryl and aralkyl group.

In one embodiment, the yellow color forming compound has a structure according to Formula YCFC, wherein R and R' independently represent a linear alkyl group, a branched alkyl group, an aryl or an aralkyl group substituted by at least one functional group containing an oxygen atom, a sulphur atom or a nitrogen atom.

A particularly preferred yellow color forming compound is the compound according to Formula YCFC wherein both R and R' are methyl.

In a most preferred embodiment of a laser markable layer for producing a yellow color, the yellow color forming compound has a structure according to Formulae YCFC1 or YCFC2

YCFC1

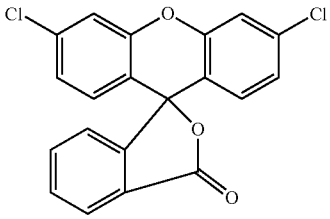

YCFC2

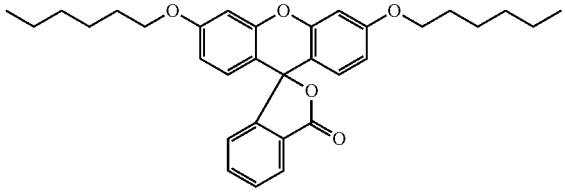

In a preferred embodiment of a laser markable layer for producing a black colour, the black colour forming compound has a structure according to Formula BCFC

BCFC

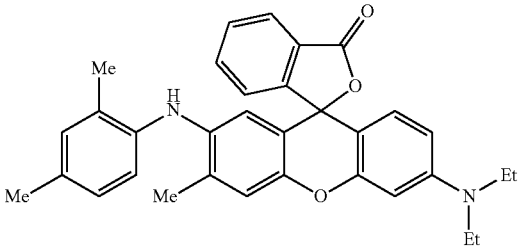

wherein Me=methyl and Et=Ethyl.

Polymeric Binder

The laser markable layer may include a polymeric binder. In principle any suitable polymeric binder that does not prevent the colour formation in the laser markable layer(s) may be used. The polymeric binder may be a polymer, a copolymer or a combination thereof.

The laser markable layer preferably includes a polymeric binder comprising vinyl acetate and at least 85 wt % of vinyl chloride based on the total weight of the binder. The polymeric binder is preferably a copolymer including at least 85 wt % of a vinyl chloride and 1 wt % to 15 wt % of vinyl acetate, more preferably a copolymer including at least 90 wt % of a vinyl chloride and 1 wt % to 10 wt % of vinyl acetate with all wt % based on the total weight of the binder.

In a preferred embodiment, the polymeric binder includes at least 4 wt % of vinyl acetate based on the total weight of the binder. The advantage of having at least 4 wt % of vinyl acetate in the polymeric binder is that the solubility of the polymeric binder is drastically improved in preferred coating solvents, such as methyl ethyl ketone.

In a more preferred embodiment, the polymeric binder consists of vinyl chloride and vinyl acetate.

The polymeric binder is preferably present in the colour forming layer in an amount of 1 to 30 g/m$^2$, more preferably in an amount of 2 to 20 g/m$^2$, most preferably in an amount of 3 to 10 g/m$^2$.

Acid Scavenger

The laser markable layer may contain one or more acid scavengers.

Acid scavengers include organic or inorganic bases. Examples of the inorganic bases include hydroxides of alkali metals or alkaline earth metals; secondary or tertiary phosphates, borates, carbonates; quinolinates and metaborates of alkali metals or alkaline earth metals; a combination of zinc hydroxide or zinc oxide and a chelating agent (e.g., sodium picolinate); hydrotalcite such as Hycite 713 from Clariant; ammonium hydroxide; hydroxides of quaternary alkylammoniums; and hydroxides of other metals. Examples of the organic bases include aliphatic amines (e.g., trialkylamines, hydroxylamines and aliphatic polyamines); aromatic amines (e.g., N-alkyl-substituted aromatic amines, N-hydroxylalkyl-substituted aromatic amines and bis[p-(dialkylamino) phenyl]-methanes), heterocyclic amines, amidines, cyclic amidines, guanidines and cyclic guanidines.

Other preferred acid scavangers are HALS compounds. Example of suitable HALS include Tinuvin™ 292, Tinuvin™ 123, Tinuvin™ 1198, Tinuvin™ 1198 L, Tinuvin™ 144, Tinuvin™ 152, Tinuvin™ 292, Tinuvin™ 292 HP, Tinuvin™ 5100, Tinuvin™ 622 SF, Tinuvin™ 770 DF, Chimassorb™ 2020 FDL, Chimassorb™ 944 LD from BASF; Hostavin 3051, Hostavin 3050, Hostavin N 30, Hostavin N321, Hostavin N 845 PP, Hostavin PR 31 from Clariant.

Further examples of acid scavengers are salts of weak organic acids such as carboxilates (e.g. calcium stearate).

A preferred acid scavanger is an organic base, more preferably an amine.

A particular preferred acid scavenger is an organic base having a pKb of less than 7.

UV Absorbers

The laser markable article may also comprise an UV-absorber. The UV-absorber may be present in a laser markable layer or may also be present in another layer, for example, an outer layer. In a preferred embodiment, the UV-absorber is present in an outer layer.

Examples of suitable UV-absorbers include 2-hydroxyphenyl-benzophenones (BP) such as Chimassorb™ 81 and Chimassorb™ 90 from BASF; 2-(2-hydroxyphenyl)-benzotriazoles (BTZ) such as Tinuvin™ 109, Tinuvin™ 1130, Tinuvin™ 171, Tinuvin™ 326, Tinuvin™ 328, Tinuvin™ 384-2, Tinuvin™ 99-2, Tinuvin™ 900, Tinuvin™ 928, Tinuvin™ Carboprotect™, Tinuvin™ 360, Tinuvin™ 1130, Tinuvin™ 327, Tinuvin™ 350, Tinuvin™ 234 from BASF, Mixxim™ BB/100 from FAIRMOUNT, Chiguard 5530 from Chitec; 2-hydroxy-phenyl-s-triazines (HPT) such as Tinuvin™ 460, Tinuvin™ 400, Tinuvin™ 405, Tinuvin™ 477, Tinuvin™ 479, Tinuvin™ 1577 ED, Tinuvin™ 1600 from BASF, 2-(2,4-dihydroxyphenyl)-4,6-bis-(2,4-dimethylphenyl)-s-triazine (CASRN1668-53-7) from Capot Chemical Ltd and 4-[4,6-bis(2-methyl-phenoxy)-1,3,5-triazin-2-yl]-1,3-benzenediol (CASRN13413-61-1); titanium dioxide such as Solasorb 100F from from Croda Chemicals; zink oxide such as Solasorb 200F from Croda Chemicals; benzoxazines such as Cyasorb UV-3638 F, CYASORB™ UV-1164 from CYTEC; and oxamides such as Sanduvor VSU from Clariant.

Preferred UV absorbers have in the wavelength region between 300 and 400 nm a maximum absorption above 330 nm, more preferably above 350 nm.

Particular preferred UV absorbers are hydroxyphenyl benzotriazoles and 2-hydroxyphenyl-s-triazines having a maximum absorption above 350 nm in the wavelength region 300-400 nm.

The UV-absorber may be present in a laser markable layer or may also be present in another layer, for example, an outer layer. In a preferred embodiment, the UV-absorber is present in an outer layer.

Polymeric Supports

The laser markable layer may be applied as a laser markable laminate comprising the laser markable layer applied on a transparent polymeric support. The transparent polymeric support is preferably a transparent axially stretched polyester support. The laser markable layer is coated directly on the polymeric support or on a subbing layer present on the polymeric support for improving adhesion of the laser markable layer, thereby preventing falsification through delamination.

Suitable transparent polymeric supports include cellulose acetate propionate or cellulose acetate butyrate, polyesters such as polyethylene terephthalate and polyethylene naphthalate, polyamides, polycarbonates, polyimides, polyolefins, polyvinylchlorides, polyvinylacetals, polyethers and polysulphonamides.

In the most preferred embodiment, the transparent polymeric support is a biaxially stretched polyethylene terephthalate foil (PET-C foil) to be very durable and resistant to scratches and chemical substances.

The support preferably is a single component extrudate, but may also be a co-extrudate. Examples of suitable co-extrudates are PET/PETG and PET/PC.

Polyester supports and especially polyethylene terephthalate supports are preferred because of their excellent properties of dimensional stability. When polyester is used as the support material, a subbing layer is preferably employed to improve the bonding of layers, foils and/or laminates to the support.

The manufacturing of PET-C foils and supports is well-known in the art of preparing suitable supports for silver halide photographic films. For example, GB 811066 (ICI) teaches a process to produce biaxially oriented polyethylene terephthalate foils and supports.

The polyethylene terephthalate is preferably biaxially stretched with a stretching factor of at least 2.0, more preferably at least 3.0 and most preferably a stretching factor of about 3.5. The temperature used during stretching is preferably about 160° C.

Methods to obtain opaque polyethylene terephthalate and biaxially oriented films thereof of have been disclosed in, e.g. US2008/238086.

Subbing Layers

The polymeric support may be provided with one or more subbing layers. This has the advantage that the adhesion between the laser markable layer and the polymeric support is improved.

Useful subbing layers for this purpose are well known in the photographic art and include, for example, polymers of vinylidene chloride such as vinylidene chloride/acrylonitrile/acrylic acid terpolymers or vinylidene chloride/methyl acrylate/itaconic acid terpolymers.

The application of subbing layers is well-known in the art of manufacturing polyester supports for silver halide photographic films. For example, the preparation of such subbing layers is disclosed in U.S. Pat. No. 3,649,336 (AGFA) and GB1441591 (AGFA);

Suitable vinylidene chloride copolymers include: the copolymer of vinylidene chloride, N-tert.-butylacrylamide, n-butyl acrylate, and N-vinyl pyrrolidone (e.g. 70:23:3:4), the copolymer of vinylidene chloride, N-tert.-butylacrylamide, n-butyl acrylate, and itaconic acid (e.g. 70:21:5:2), the copolymer of vinylidene chloride, N-tert.-butylacrylamide, and itaconic acid (e.g. 88:10:2), the copolymer of vinylidene chloride, n-butylmaleimide, and itaconic acid (e.g. 90:8:2), the copolymer of vinyl chloride, vinylidene chloride, and methacrylic acid (e.g. 65:30:5), the copolymer of vinylidene chloride, vinyl chloride, and itaconic acid (e.g. 70:26:4), the copolymer of vinyl chloride, n-butyl acrylate, and itaconic acid (e.g. 66:30:4), the copolymer of vinylidene chloride, n-butyl acrylate, and itaconic acid (e.g. 80:18:2), the copolymer of vinylidene chloride, methyl acrylate, and itaconic acid (e.g. 90:8:2), the copolymer of vinyl chloride, vinylidene chloride, N-tert.-butylacrylamide, and itaconic acid (e.g. 50:30:18:2). All the ratios given between brackets in the above-mentioned copolymers are ratios by weight.

In a preferred embodiment, the subbing layer has a dry thickness of no more than 2 μm or preferably no more than 200 mg/m$^2$.

Coating Solvents

For coating the laser markable layer(s) and the optional additional layers, one or more organic solvents may be used. The use of an organic solvent facilitates the dissolution of the polymeric binder and specific ingredients such as the infrared dye.

A preferred organic solvent is methylethylketone (MEK) because it combines a high solubilizing power for a wide range of ingredients and it provides, on coating the laser markable layer, a good compromise between the fast drying of the layer(s) and the danger of fire or explosion thereby allowing high coating speeds.

However, the aqueous laser markable layers disclosed in EP-A 14196741.4 and EP14196745.5 both filed on Aug. 12, 2014 may also be used in the present invention and may result in a more environmently friendly preparation method while maintaining or even improving their physical properties and daylight stability.

Core Supports

The security article includes an opaque core support. The core support is preferably an opaque white core support. The advantage of an opaque white core support is that any information present on the document is more easily readable and that a colour image is more appealing by having a white background.

Preferred opaque white core supports include resin coated paper supports, such as polyethylene coated paper and polypropylene coated paper, and synthetic paper supports such as Synaps™ synthetic paper of Agfa-Gevaert NV.

Other examples of useful high-quality polymeric supports for the present invention include opaque white polyesters and extrusion blends of polyethylene terephthalate and polypropylene. Also Teslin™ may be used as support.

Instead of a white support, a white opacifying layer can be coated onto a transparent polymeric support, such as those disclosed above. The opacifying layer preferably contains a white pigment with a refractive index greater than 1.60, preferably greater than 2.00, and most preferably greater than 2.60. The white pigments may be employed singly or in combination. Suitable white pigments include C.I. Pigment White 1, 3, 4, 5, 6, 7, 10, 11, 12, 14, 17, 18, 19, 21, 24, 25, 27, 28 and 32. Preferably titanium dioxide is used as pigment with a refractive index greater than 1.60. Titanium oxide occurs in the crystalline forms of anatase type, rutile type and brookite type. In the present invention the rutile type is preferred because it has a very high refractive index, exhibiting a high covering power.

Laser Marking Method

A method of forming interlaced images in the security article as described above comprises the steps of forming N interlaced images by N laser exposures, all exposures having a different incident angle.

A preferred method of forming interlaced images in the security article described above comprises the steps of:

forming a first image in a laser markable layer (30) by a first laser exposure having a first incident angle, and forming a second image in the laser markable layer (30) by second laser exposure having a second incident angle.

The difference between the first and second incident angles is preferably at least 10°, more preferably at least 20°, most preferably at least 30°.

When more than one laser markable layer is present, each capable of forming a different colour, more than one laser exposure, each having a different IR exposure wavelength, having a first incident angle and more than one laser exposure, each having a different IR exposure wavelength, having a second incident angle may be used to form interlaced colour images.

For example, when three laser markable layers are present each capable of forming a different colour upon IR laser exposure, for example Yellow, Magenta and Cyan, a preferred method for preparing a laser marked article is disclosed in EP-A 2719540 uses three infrared lasers L-1, L-2 and L-3 having respectively a laser emission wavelength of λ(L-1), λ(L-2) and λ(L-3).

Other Security Features

The laser markable article may be combined with one or more other security features to increase the difficulty for falsifying the document.

To prevent forgeries of identification documents, different means of securing are used. One solution consists in superimposing lines or guilloches on an identification picture such as a photograph. In that way, if any material is printed subsequently, the guilloches appear in white on added black background. Other solutions consist in adding security elements such as information printed with ink that reacts to ultraviolet radiation, micro-letters concealed in an image or text etc.

Suitable other security features such as anti-copy patterns, guilloches, endless text, miniprint, microprint, nanoprint, rainbow colouring, 1D-barcode, 2D-barcode, coloured fibres, fluorescent fibres and planchettes, fluorescent pigments, OVD and DOVID (such as holograms, 2D and 3D holograms, Kinegrams™, overprint, relief embossing, perforations, metallic pigments, magnetic material, Metamora colours, microchips, RFID chips, images made with OVI (Optically Variable Ink) such as iridescent and photochromic ink, images made with thermochromic ink, phosphorescent pigments and dyes, watermarks including duotone and multitone watermarks, ghost images and security threads.

EXAMPLES

Materials

All materials used in the following examples were readily available from standard sources such as ALDRICH CHEMICAL Co. (Belgium) and ACROS (Belgium) unless otherwise specified. The water used was deionized water.

CCE is Bayhydrol H 2558, an anionic polyester urethane (37.3%) from BAYER.

Resorcinol from Sumitomo Chemicals.

Par is a dimethyltrimethylolamine formaldehyde resin from Cytec industries.

PAR-sol is a 40 wt % aqueous solution of Par.

PEA is Tospearl™ 120 from Momentive Performance materials.

PEA-sol is a 10 wt % (50/50) aqueous/ethanol dispersion of PEA.

Dowfax™ 2A1 from Pilot Chemicals C is a Alkyldiphenyloxide disulfonate (4.5% wt %).

DOW-sol is a 2.5 wt % solution of Dowfax™ 2A1 in isopropanol.

Surfynol™ 420 from Air Products is a non ionic surfactant.

Surfynsol is a 2.5 wt % solution of Surfynol™ 420 in isopropanol.

MEK is an abbreviation used for methylethylketone.

Solvin™ 557RB is a vinylchloride-vinylacetate copolymer with 11% vinyl acetate, provided by SOLVAY.

Baysilone® Paint Additive MA is a methylpolysiloxane from Bayer.

Baysol is a 5 wt % solution of Baysilone® Paint Additive MA in MEK.

HALS is Tinuvin 770 commercially available from BASF.

IR1 is an IR dye with the following formula and prepared as disclosed in EP-A 2463109 (Agfa), paragraphs [0150] to [0159].

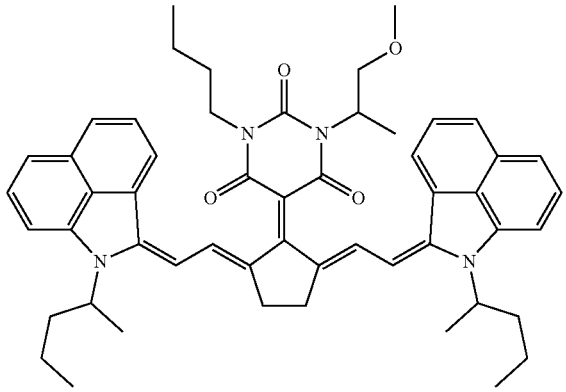

LD1 is the leuco dye Pergascript Black 2C from BASF.

LD2 is the leuco dye Pergascript Red I 6Bf from BASF.

ORGASOL is ORGASOL® 3501 EXD NAT 1, a spheroidal powder of copolyamide 6/12, with 10 μm as average diameter from Orgasol.

Example 1

Preparation of the Top Lenticular Lens Sheet (TLL-01)

The lenticular lenses were embossed in a polycarbonate sheet using a CLI master (from CETIS, Slovenia).

Figure 2:
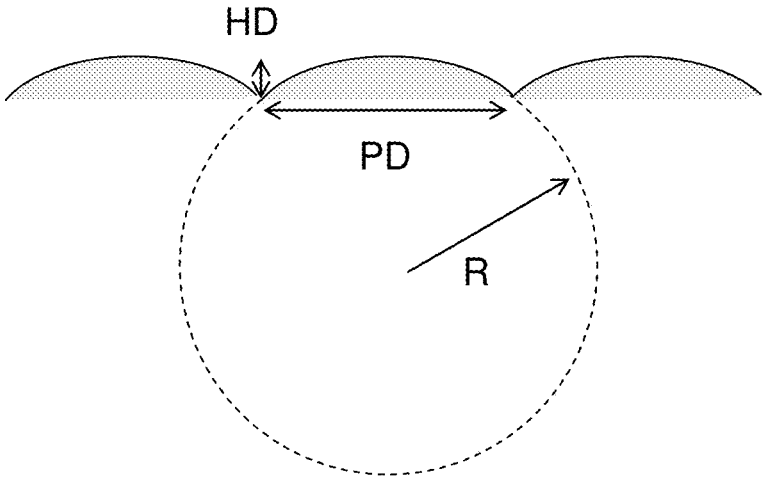
FIG. 2 shows the parameters of an embodiment of a microlens of a security article according to the present invention.

A CLI master is a metallic plate of 0.8 mm on which many circular area's containing cylindrical shapes (lenses) were provided. Upon embossing these cylindrical shapes on the polycarbonate foil, cylindrical lenses were formed in the polycarbonate foil or sheet. The CLI master from CETIS had circular area's containing cylindrical shapes (lenses) with 10 different shape-parameters, as shown in Table 1. The parameters R, PD and HD of Table 1 are illustrated in FIG. 2.

TABLE 1

| CLI # | Radius R | Peaks Distance PD (μm) | High Distance (HD) (μm) |
|---|---|---|---|
| 1 | 130 | 142 | 19 |
| 2 | 130 | 178 | 33 |
| 3 | 150 | 159 | 16 |
| 4 | 150 | 202 | 25 |
| 5 | 150 | 236 | 42 |
| 6 | 180 | 205 | 25 |
| 7 | 180 | 238 | 33 |
| 8 | 180 | 277 | 50 |
| 9 | 130 | 235 | 60 |
| 10 | 180 | 275 | 78 |

Embossing of the cylindrical lenses into the surface of the polycarbonate sheet was realized by lamination in a Lauffer LC70/1 laminator using:

heating cycle: 180° C.-250N/cm$^2$-10 minutes under vacuum, and cooling cycle: from 110° to 50° C. in 18 minutes at a pressure of 250N/cm$^2$.

The following stacker, in this order, was used in the lamination process:

metal plate 6.0 mm

YAMAUCHI (YOMO1FGK) lamination mat commercially available from YAMAUCHI

CETIS master

Figure 3:
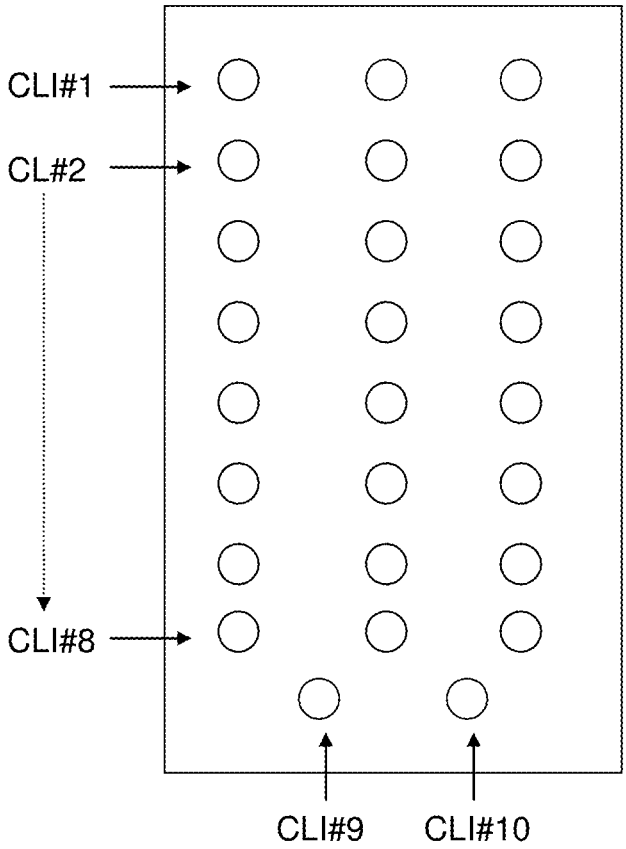
FIG. 3 shows a schematic top view of the Top Lenticular lens layer or sheet TLL-01 used in the examples.

100 μm polycarbonate sheet from BAYER lamination plate (0.8 mm, metal) commercially available Cardel YAMAUCHI (YOMO1FGK) lamination mat commercially available from YAMAUCHI metal plate 6.0 mm metal plate 5.4 mm delivered together with the laminator After lamination, the Top lenticular lens sheet (TLL-01), comprising different lenticular lenses, was obtained. A schematic top view of TLL-01 is shown in FIG. 3.

Preparation of the Laser Markable Laminate LML-01

A coating composition SUB was prepared by mixing the components according to Table 2 using a dissolver.

A 1100 μm thick polyethylene terephthalate sheet was first longitudinally stretched and then coated on both sides with the coating composition SUB at a wet thickness of 10 μm. After drying, the longitudinally stretched and coated polyethylene terephthalate sheet was transversally stretched to produce a double sided subbed 63 μm thick sheet PET-C, which was transparent and glossy

TABLE 2

| Components of SUB | wt % |
|---|---|
| deionized water | 76.66 |
| CCE | 18.45 |
| Resorcinol | 0.98 |
| PAR-sol | 0.57 |
| PEA-sol | 0.68 |
| DOW-sol | 1.33 |
| Surfynsol | 1.33 |

The laser markable laminate LML-01 was obtained by coating a laser markable layer comprising the components as defined in Table 3 onto the PET-C foil described above. The coating solutions were applied at a wet coating thickness of 75 μm and dried for 1 minute at room temperature followed by drying at 90° C. for 6 minutes in a circulation oven. The dry coating thickness of the laser markable layer was 7 μm.

TABLE 3

| Ingredients | Amount (g) |
|---|---|
| Baysol | 0.313 |
| MEK | 75.602 |
| Solvin ®557RG | 9.492 |
| HALS | 0.067 |
| ORGASOL | 0.00440 |
| LD1 | 0.971 |
| LD2 | 0.645 |
| IR1 | 12.907 |

Preparation of the Inventive Security Cards SC-01 and SC-02

A security card was prepared by laminating in a Lauffer LC70/1 laminator using identical warming and cooling cycli as described above for the embossing of the lenticular lenses in the polycarbonate sheet, but now using the following stacker, in this order:

metal plate 6.0 mm

YAMAUCHI (YOMO1FGK) lamination mat commercially available from YAMAUCHI

Figure 4:
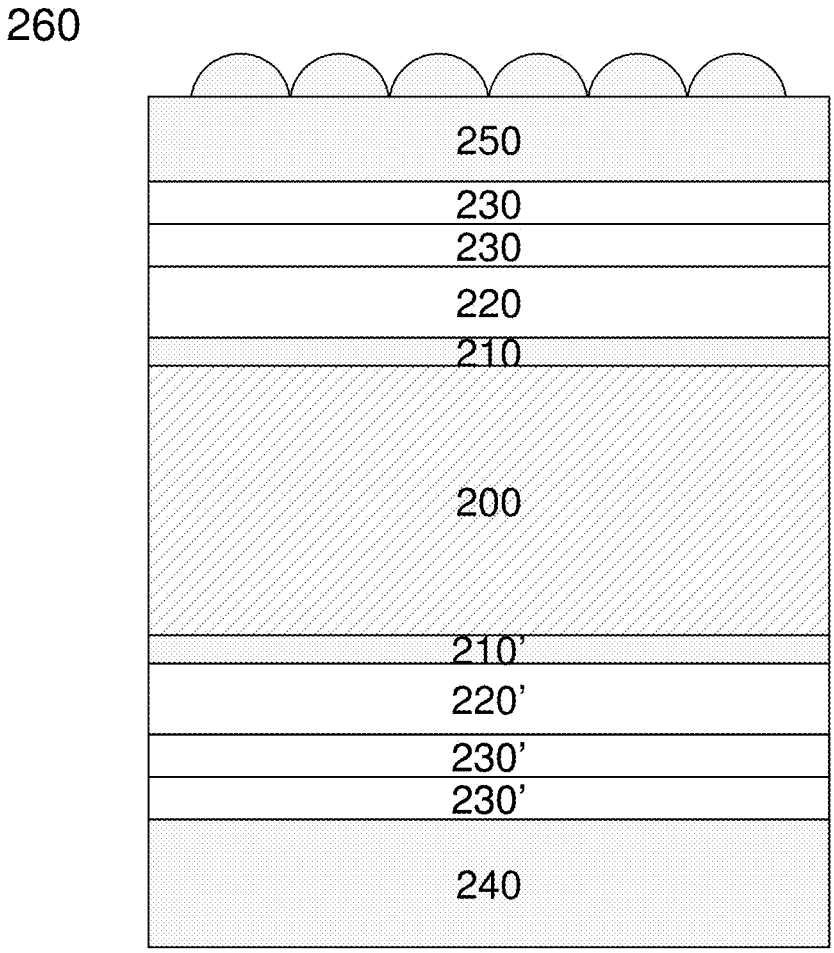
FIG. 4 shows a schematic cross section of the Security Cards made and evaluated in the examples.

Top lenticular lens sheet (TLL-01) (FIG. 4, 250)

Transparent PETG spacer sheet(s) 35 μm commercially available from AMCOR (FIG. 4, 230)

Laser markable Laminate LML-01 (laser markable layer towards the PETG CORE) (FIG. 4, 210)

Opaque 100 μm PETG CORE commercially available from Folien Wolfen GmbH (FIG. 4, 200)

Laser markable Laminate LML-01 (laser markable layer towards the PETG CORE) (FIG. 4, 210)

Transparent PETG spacer sheet(s) 35 μm commercially available from AMCOR FIG. 4, (230)

100 μm polycarbonate sheet commercially available from BAYER (FIG. 4, 240)

lamination plate (0.8 mm, metal) commercially available Cardel

YAMAUCHI (YOMO1FGK) lamination mat commercially available from YAMAUCHI.

metal plate 6.0 mm metal plate 5.4 mm delivered together with the laminator

After lamination, a sheet with the same size as the CLI master plate from CETIS (50×30 cm) was obtained with on one side the Top lenticular lens sheet (TLL-01) having many circular areas (13 mm diameter) with embossed lenses.

The layer built-up of the obtained laminate is schematically shown in FIG. 4.

Top lenticular lens sheet (TLL-01) (250)

Transparant PETG spacer sheets (230)

PET-C support of the Laser markabel laminate (220)

Laser markable layer (210)

Opaque PET G CORE (200)

Laser markable layer (210')

PET-C support of the Laser markabel laminate (220')

Transparant PETG spacer sheets (230')

polycarbonate sheet (240)

The number of spacer sheets depends on the choice of the lenses in the top sheet TLL-01. Depending on the chosen parameters R and PD, there is a depth Y at which the laser markable layer (210) has to be placed, in order to achieve optimal contrast between the two images, encoded in the laser markable layer, and intended to be viewed independently from each other at 2 different viewing angles.

As we have chosen CLI#2 from the CETIS master in the examples, it turns out that 2 to 3 spacer layers of 35 μm each were the optimal choice.

The laser markable layer (210) is capable of forming a black colour upon exposure to IR radiation by a colour forming reaction of the Leuco dyes LD1 and LD2.

The individual security cards SC-01 up to SC-02 were cut from the above prepared laminate. Each security card SC-01 up to SC-02 contained 1 circular area with lens structures of type CLI #2. Two replica's of each card were made: replica #1 was used for an IR exposure at 0° while replica #2 was used for an IR exposure at 30°.

SC-01 was made as described above with 2 spacer sheet, while SC-02 was made with 3 spacer sheets.

Preparation of the Comparative Security Cards SC-03 and SC-04

The comparative security cards SC-03 and SC-04 were prepared as described for SC-01 and SC-02 except that instead of the laser markable laminate LML-01, a ±95 μm laser markable PETG sheet (comprising polycarbonate) commercially available from Folien Wolfen GmbH. This state in the art laser markable sheet is capable of forming a black and white picture by carbonization of the polycarbonate upon exposure to IR radiation.

Preparation of the Interlaced Images L(0°) and L(30°)

The images L(0°) and L(30°) were exposed into the laser markable layer (210), located on the side of the core 200 facing the top lens layer 250 of the security cards SC-01 to SC-04, with a Rofin-Sinar laser incorporated in a commercially available Muehlbauer CLP54.

The laser has the following specifications:

wavelength=1064 nm pulsing with acoustic-optic switch: 0 to 100 kHz lens focal length=160 mm distance laser—security card: 235 mm power=8 watt The laser settings used to expose the images L(0°) and L(30°) were:

laser current: 25 Ampère for SC-01 and SC-02 and 27 Ampère for SC-03 and SC-04 frequency: 22 kHz speed: 200 mm/sec line width: 0.04 mm pulse width: 1 μsec.

The image L(0°) for which an exposure angle of 0° was used was exposed on replica#1 of the security cards SC-01 to SC-04, the image L(30°) for which an exposure angle of 30° was used was exposed on replica#2 of the security cards SC-01 to SC-04. The images were exposed through the embossed lens structures with parameters CL#2 (see Table 1).

The images L(30°) and L(0°) were obtained by exposing a bitmap of 560 pixels wide by 280 pixels high. All pixels in the bitmap had the same grey level, being 15. The bitmap was exposed with a resolution setting in the software of the Muehlbauer CLP54 of 536 dpi, both horizontal and vertical. This resulted in images of 26.5×13.3 mm.

The images L(30°) and L(0°) were looked at with a camera at different viewing angles.

For evaluation of the achieved contrast, replica #1 and #2 of cards SC-01 & SC-03 were combined with tape to form a 4-card composite. The 4-card composite was mounted onto a rotating rod. On the rod, there was also a grid of lines, indicating the angle.

A digital CCD camera (Pike F145C camera from AVT Allied Vision Technologies GmbH http://www.alliedvisiontec-.com) was filming the 4-card composite as the rod was (manually) being rotated from about −70° up to about +70°. The camera was used in monochrome mode as the images were black&white images. The thus obtained video sequence was analysed using image processing & analysis software Image-Pro Plus from Media Cybernetics (http://www.mediacy.com/). Each frame of the video sequence corresponds to a certain angle in the range from about −70° up to about +70°. In each frame of the video sequence, 4 area-of-intrest (AOI) were defined, well inside each of the 4 circular area's:

AOI 1 was inside CLI #2 of replica #1 of SC-01 (thin LML, exposed at 0°)

AOI 2 was inside CLI #2 of replica #2 of SC-01 (thin LML, exposed at 30°)

AOI 3 was inside CLI #2 of replica #1 of SC-03 (thick LML, exposed at 0°)

AOI 4 was inside CLI #2 of replica #2 of SC-03 (thick LML, exposed at 30°)

A picture of the 4-card composite described above is shown in FIG. 9. On that FIG. 9, the location of the 4 AOI's is indicated.

The average greylevel (AGL) of all pixels inside the AOI were calculated. It is a measure of the brightness/darkness of the CLI, as viewed at the given angle, corresponding to the frame of the video sequence. The camera looks at the composite much like a human observer would look at it. In that sense, the measured brightness is comparable to how a human observer would judge the brightness.

Figure 5A:
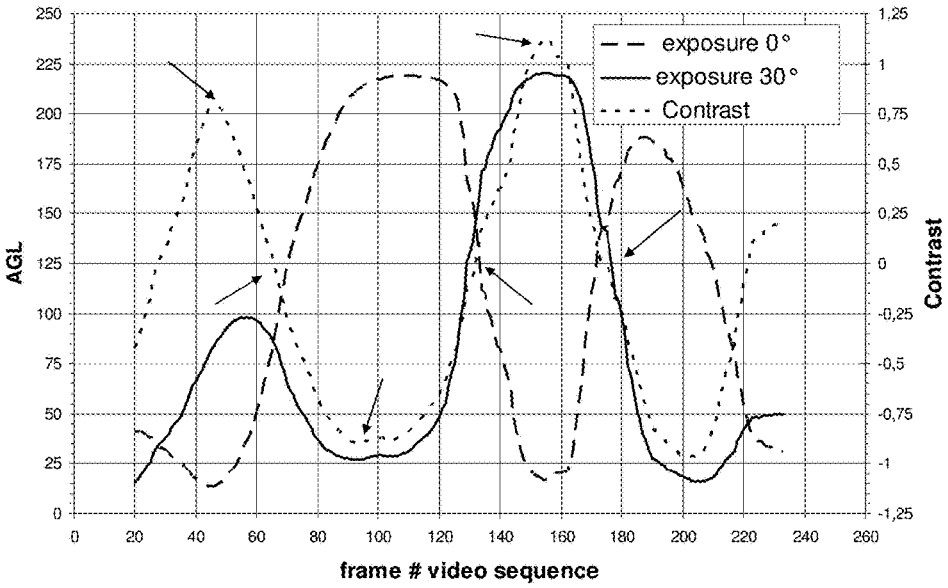
FIGS. 5*a* and 5*b* show the Average Grey Level (AGL) of the images exposed at respectively 0° and 30° and the Contrast of the two images as function of the viewing angle of the security card SC-01 prepared in the examples.
Figure 6A:
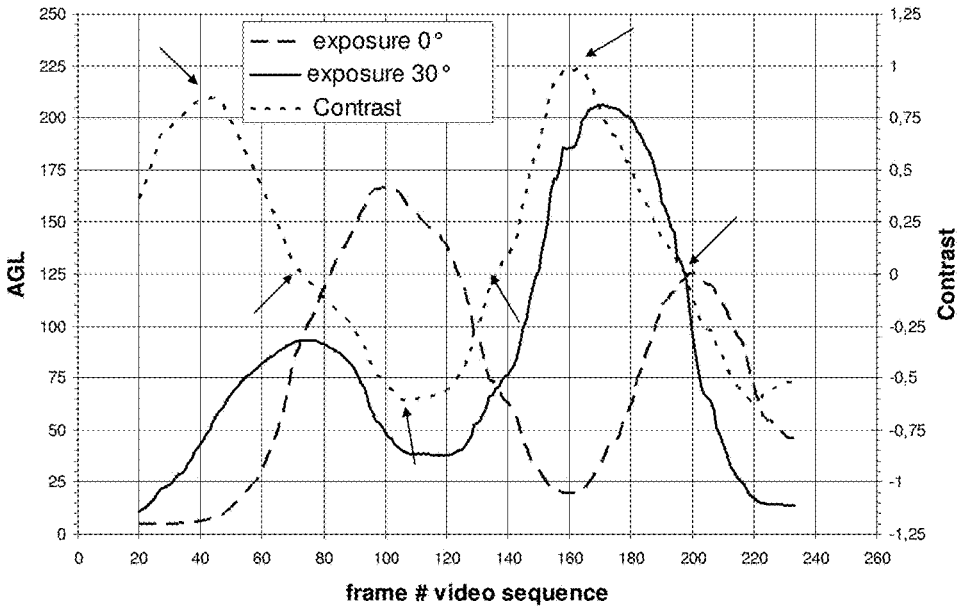
FIGS. 6*a* and 6*b* show the Average Grey Level (AGL) of the images exposed at respectively 0° and 30° and the Contrast of the two images as function of the viewing angle of the security card SC-03 prepared in the examples.

The average greylevel (AGL) of both images (L(0°) and L(30°) for SC-01 and SC-03 is plotted against the frame-number in the video sequence (See FIGS. 5*a* and 6*a*). The frame-number can be converted into angle.

For each frame, the contrast is calculated as −Log(AGL @0°/AGL @30°), where AGL@0° is the average greylevel of the image exposed at 0° and AGL@30° is the average greylevel of the image exposed at 30°.

This Contrast is also plotted against the frame-number in FIGS. 5*a* and 6*a*. The contrast-curve exhibits a maximum contrast $C_{max}$ and a minimum contrast $C_{min}$ at a particular frame, which corresponds more or less to 0° and a 30° viewing angle, respectively. The difference in contrast, $\Delta C = C_{max} - C_{min}$, is the measure of quality we are looking for and is preferably as large as possible.

Figure 5B:
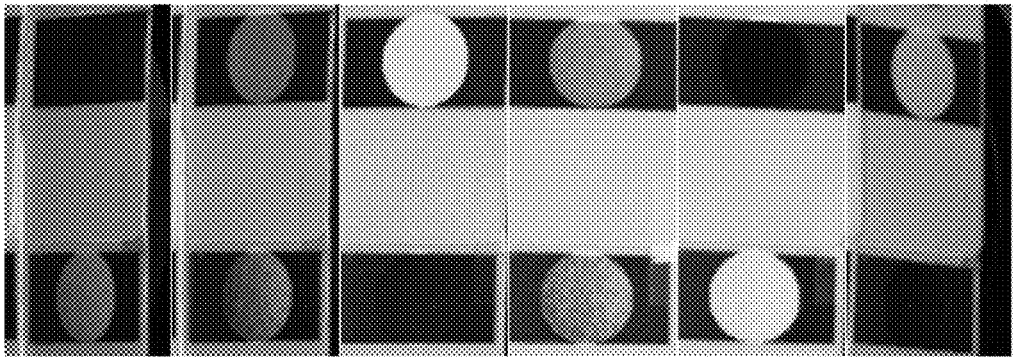
Figure 6B:
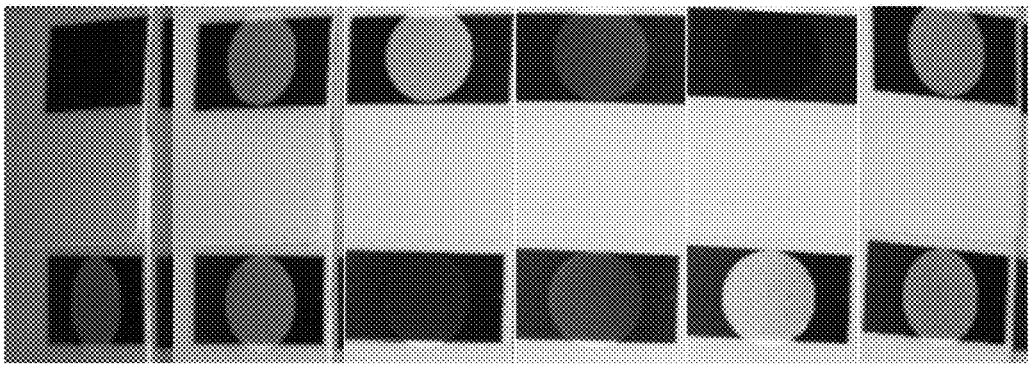

The dotted arrows in the AGL graphs of FIGS. 5*a* and 6*a* also indicate the viewing angles at which pictures of the images L(0°) and L(30°) are shown in respectively FIGS. 5*b* and 6*b*.

Figure 7A:
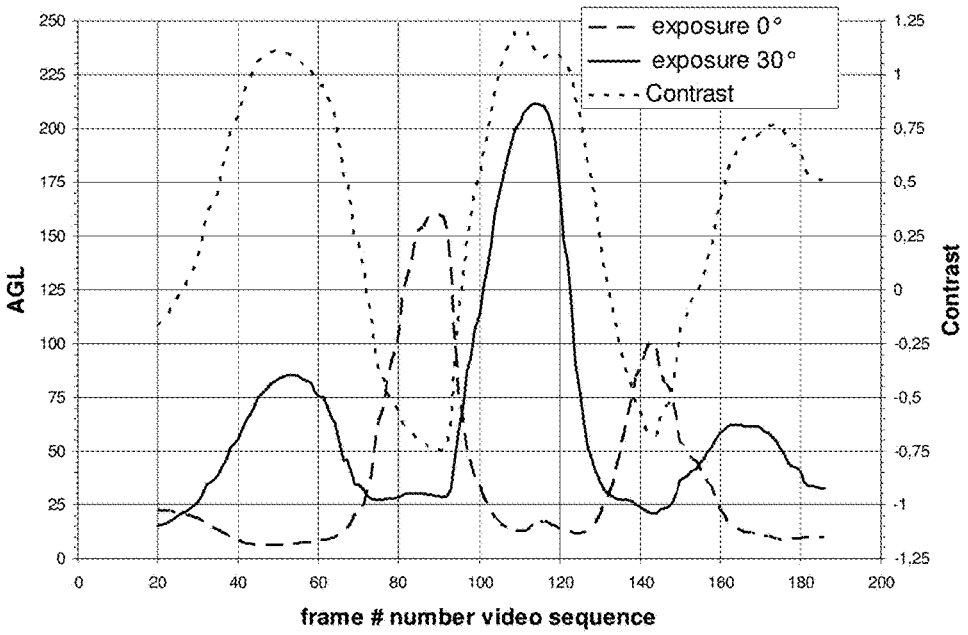
FIGS. 7*a* and 7*b* show the Average Grey Level (AGL) of the images exposed at respectively 0° and 30° and the Contrast of the two images as function of the viewing angle of the security card SC-02 prepared in the examples.
Figure 7B:
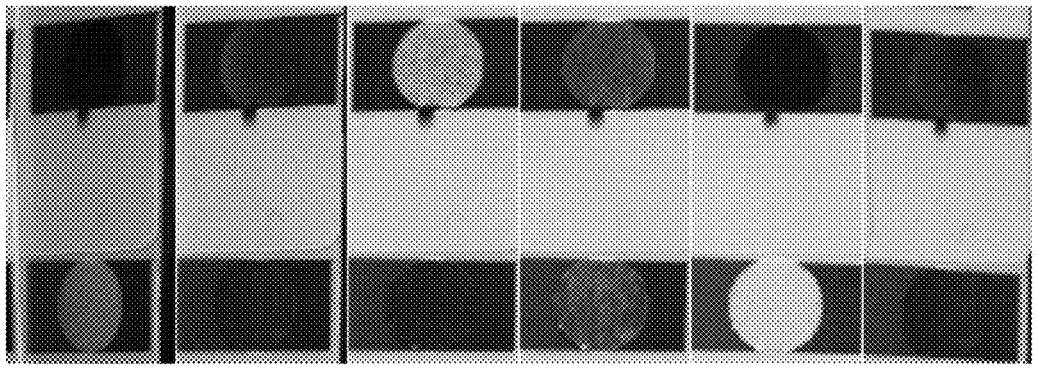
Figure 8A:
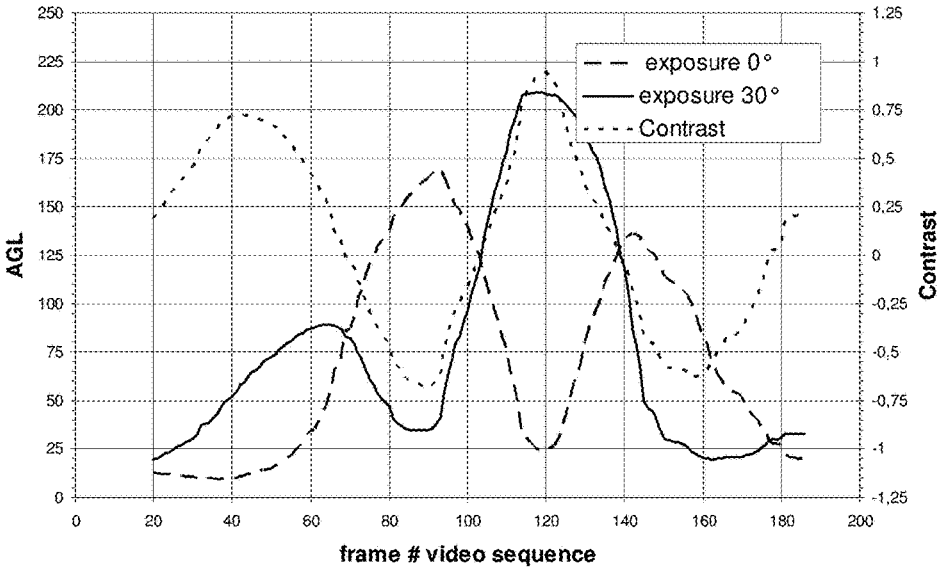
FIGS. 8*a* and 8*b* show the Average Grey Level (AGL) of the images exposed at respectively 0° and 30° and the Contrast of the two images as function of the viewing angle of the security card SC-04 prepared in the examples.
Figure 8B:
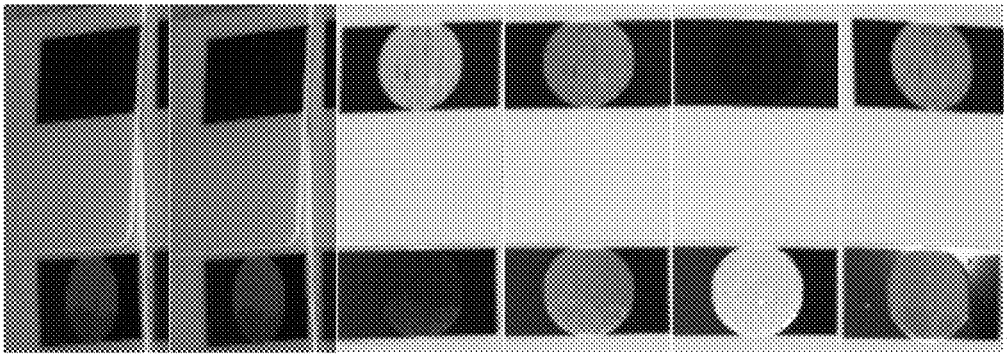

The same procedure was repeated for CLI #2 of cards SC-02 & SC-04, the security cards with 3 spacer layers (see also FIGS. 6 and 7).

The dotted arrows in the AGL graphs of FIGS. 4 to 7 (FIGS. 4*a* to 7*a*) indicate the viewing angles at which pictures of the images L(0°) and L(30°) are shown in respectively FIGS. 4*b* to 7*b*.

The Δcontrast values SC-01 to SC-04 are shown in Table 4.

TABLE 4

| SC | Thickness Laser Markable Layer | CLI | $C_{max}$ | $C_{min}$ | Δcontrast |
|---|---|---|---|---|---|
| SC-01 (INV) | 7 μm | CLI#2 | 1.13 | −0.96 | 2.09 |
| SC-02 (INV) | 7 μm | CLI#2 | 1.21 | −0.74 | 1.95 |
| SC-03 (COMP) | 95 μm | CLI#2 | 0.98 | −0.62 | 1.60 |
| SC-04 (COMP) | 95 μm | CLI#2 | 0.94 | −0.68 | 1.62 |

It is clear from the results of Table 4 that higher contrast values between the images L(0°) and L(30°) were obtained with the inventive security cards having a laser markable layer with a thickness of less than 50 μm.

The improved contrast of SC-01 and SC-02, compared to SC-03 and SC-04, is also clear from the pictures of the images L(0°) and L(30°) shown in respectively FIGS. 4*b* to 7*b*.

The invention claimed is:

1. A security article comprising:

an opaque core support;

a laser markable layer over the opaque core support; and a transparent outer layer over the laser markable layer, the transparent outer layer including lenticular lenses on an outer surface thereof; wherein the laser markable layer has a dry layer thickness of less than 50 μm; and the laser markable layer includes a leuco dye and an infrared absorbing compound.

2. The security article according to claim 1, wherein the laser markable layer has a dry thickness of less than 25 μm.

3. The security article according to claim 1, further comprising a spacer layer between the laser markable layer and the transparent outer layer.

4. The security article according to claim 1, wherein the lenticular lenses include an array of spherical or cylindrical lenses.

5. The security article according to claim 1, further comprising at least a second laser markable layer.

6. The security article according to claim 5, wherein a sum of the dry layer thickness of all laser markable layers is less than 50 μm.

7. The security article according to claim 1, wherein the security article is a security document selected from the group consisting of a passport, a personal identification card, and a product identification document.

8. A method of forming interlaced images in the security article according to claim 1, the method comprising the steps of:

forming N images using N laser exposures; wherein all exposures have different incident angles.

9. The method according to claim 8, further comprising the steps of:

forming a first image in the laser markable layer using a laser exposure at a first incident angle; and forming a second image in the laser markable layer using a laser exposure at a second incident angle different from the first incident angle.

10. The method according to claim 9, wherein the first incident angle and the second incident angle differ by at least 10°.

11. The method according to claim 9, wherein each of the first laser exposure and the second laser exposure includes infrared radiation.

* * * * *